United States Patent [19]

Seidel et al.

[11] Patent Number: 5,063,952

[45] Date of Patent: Nov. 12, 1991

[54] SELF OPENING UMBRELLA

[75] Inventors: Joachim Seidel, Solingen; Klaus Stiller, Langenfeld, both of Fed. Rep. of Germany

[73] Assignee: Kortenbach Verwaltungs-und Betiligungsgesellschaft mbH & Co., Soligen, Fed. Rep. of Germany

[21] Appl. No.: 422,078

[22] Filed: Oct. 10, 1989

[30] Foreign Application Priority Data

Mar. 17, 1989 [DE] Fed. Rep. of Germany ..... 390825

[51] Int. Cl.[5] ..... A45B 25/14

[52] U.S. Cl. ..... 135/22; 135/24; 135/25.33

[58] Field of Search ..... 135/22, 23, 24, 25 R, 135/25 A, 26, 25.1, 25.3, 25.33

[56] References Cited

U.S. PATENT DOCUMENTS

| | | | |
|---|---|---|---|
| 1,067,435 | 7/1913 | McNamara . | |
| 1,902,363 | 3/1933 | Haupt | 135/22 |
| 2,705,967 | 4/1955 | Zimmermann et al. | 135/22 |
| 3,016,910 | 1/1962 | Rosenkaimer | 135/22 |
| 4,534,374 | 8/1985 | Day | 135/22 |
| 4,682,617 | 7/1987 | Schultes | 135/22 X |

FOREIGN PATENT DOCUMENTS

| | | | |
|---|---|---|---|
| 19711 | 10/1882 | Fed. Rep. of Germany | 135/28 |
| 732465 | 3/1943 | Fed. Rep. of Germany . | |
| 193089 | 11/1957 | Fed. Rep. of Germany . | |
| 140443 | 4/1978 | German Democratic Rep. | 135/22 |
| 12816 | of 1897 | United Kingdom | 135/38 |
| 698926 | 10/1953 | United Kingdom | 135/22 |

*Primary Examiner*—David A. Scherbel
*Assistant Examiner*—Lan Mai
*Attorney, Agent, or Firm*—Samuel Meerkreebs

[57] ABSTRACT

An improvement in self-opening umbrella frames having either a one-piece or telescopic stick and a main slide and an auxilary slide on the stick to operate the a frame-rib structure which is opened automatically by a coil spring compressed between these two slides; the frame-rib structure being closed by pulling down on a tubular grip sleeve journaled for rotation on the stick and extending through the two slides, the grip sleeve having an upper abutment or carrier engaged at the top of the auxilary slide; the grip sleeve being locatable about a 360° circumference by an arresting catch on the umbrella handle at the lower end of the stick; torsional forces generated by the coiled spring during expansion and compression being isolated between the slides and not interferring with operation of the arresting catch while minimizing opening and closing effort of a user of the umbrella.

6 Claims, 1 Drawing Sheet

SELF OPENING UMBRELLA

FIELD OF THE INVENTION

The invention relates to self opening umbrella frames using either a one-piece or telescopic stick and a main slide and auxiliary slide to actuate the frame structure, which is opened automatically by means of a compression spring, compressed between these two slides, which can be closed manually by pulling down on a grip sleeve, guided along the stick; the main and auxiliary slide having limited relative displacement on the grip sleeve and the grip sleeve being connectable, on closing movement, to the auxiliary slide by means of a carrier when closing the frame and being lockable on an arresting catch on the umbrella handle when the frame or umbrella canopy is closed.

DESCRIPTION OF RELATED ART

Umbrellas of this general character; are already known, for example, from U.S. Pat. No. 1,067,435 (McNamara), can be opened quickly when required and, additionally, can be easily closed, without force, as a result of the manual actuation force on the auxiliary slide arranged above the main slide. Previously, these umbrellas have therefore proved to be very practicable however this design also has a substantial handicap. The opening spring causes a very undesirable side effect insofar as it develops strong contrary torsional forces at its ends, with the result that the two slides are also revolved in corresponding relative about the axis of the stick and, finally, the exact angular coordination of or alignment the parallel positions of the arresting means may become divergent between, on the one hand, the grip sleeve of the slide and, on the other hand, its end position at the umbrella handle with a closed umbrella.

To overcome these problems, with the umbrella according to the abovementioned patent, the main slide is guided rotatably and displaceably on the grip sleeve. However, this does not rule out the rotation of the grip sleeve due to the said torsional forces, such that it cannot be ensured that the stop on the grip handle, in the closed position of the umbrella frame will find the necessary angular alignment and engage in the arresting catch at the stick side.

Furthermore, an umbrella, as described in the preamble, is known from German Patent 732,465, in which the main slide is positioned rotatably on the grip sleeve. Additionally, the main slide and the auxiliary slide are displacably guided on the grip sleeve. However, the auxiliary slide is positioned on it in a nondisplaceable manner in that the auxiliary slide on the grip sleeve is retained, i.e., movable parallel to the stick, with a slot on a pin located on the grip sleeve. This may rule out a rotation of the auxiliary slide in relation to the grip sleeve, but it does not rule out torsional forces on these two parts in relation to the stick or the arresting catch of the grip sleeve on the stick side or on the grip side in the closed position of the umbrella roof canopy or frame. Thus, even according to this design, it is not guaranteed that the grip sleeve will engage in the arresting catch at the exact angular coincidence.

Finally, an umbrella as defined in the preamble is also known from Austrian Patent 193,089, in which the auxiliary slide is arranged displaceably and rotatably on the grip sleeve. However, in this case too, the torsion passes via the main slide directly into the roof frame structure with the same negative effect as already described.

SUMMARY OF THE INVENTION

The object of the invention is to improve and to simplify a self opening umbrella frame of the character described above in such a way that it can be more easily manufactured in mass production and, besides this, is also safer and positive in its function in that the effects, described above, of the spring torsional forces on the grip sleeve are eliminated, in particular without additional outlay of production costs.

Achievement of the object according to the invention:

According to the invention the object above is achieved by the fact that both the main slide and the auxiliary slide are arranged, in addition, rotatably on the grip sleeve. By this means, a self opening umbrella is produced with which the grip sleeve only comes into drive connection with the auxiliary slide when closing the umbrella. In addition, any rotational or tensile connection between the auxiliary slide and also the main slide, on the one hand, and the grip sleeve, on the other hand, is removed. The grip sleeve is thus also disconnected from the torsional forces of the compression spring and, as it is then also free in its orientation parallel to the stick, this also allows a very simple structure and assembly of the slide and the grip sleeve in conjunction with a stop arranged on the latter. Further a substantial simplification of operation of the umbrella is provided due to the ensured coincidence of the stop with the arresting catch on the stick side and on the grip side.

A particularly advantageous embodiment of the invention in conjunction, in particular, with a self opening umbrella of the design which can be shortened results from the fact that the main slide and the auxiliary slide are movable between the carrier, constructed as an annular shoulder, and a grip collar on the grip sleeve within a push and rotation path the length of which is dimensioned such that the frame structure, together with the telescopic stick, can additionally be shortened by an additional length in the closed and locked state.

A particularly simple embodiment of the invention, which is safe in its function, can also be achieved by the fact that in the closed position of the umbrella, the grip collar forms, with its lower edge, an entry limit, stopping at the umbrella handle, for the grip sleeve into the umbrella handle, or in the arresting catch on the grip side, and the grip sleeve engages in the arresting catch, arranged on the umbrella handle, by means of an annular groove.

Correspondingly, according to a further advantageous feature of the invention, it can be provided that the arresting device has a lock which is, in the form of a ring, surrounds the annular groove of the grip sleeve, engages in the annular groove under the effect of the spring, and disengages from the latter against the effect of the spring by means of a push button.

Finally, a particularly simple arrangement and an easy assembly of the grip sleeve, according to another advantageous development of the invention, is possible by the fact that the grip sleeve is provided with slots, parallel to the axis, at the upper end bearing the carrier.

DESCRIPTION OF THE PREFERRED EMBODIMENT

Figures 1, 2, 3, 4:
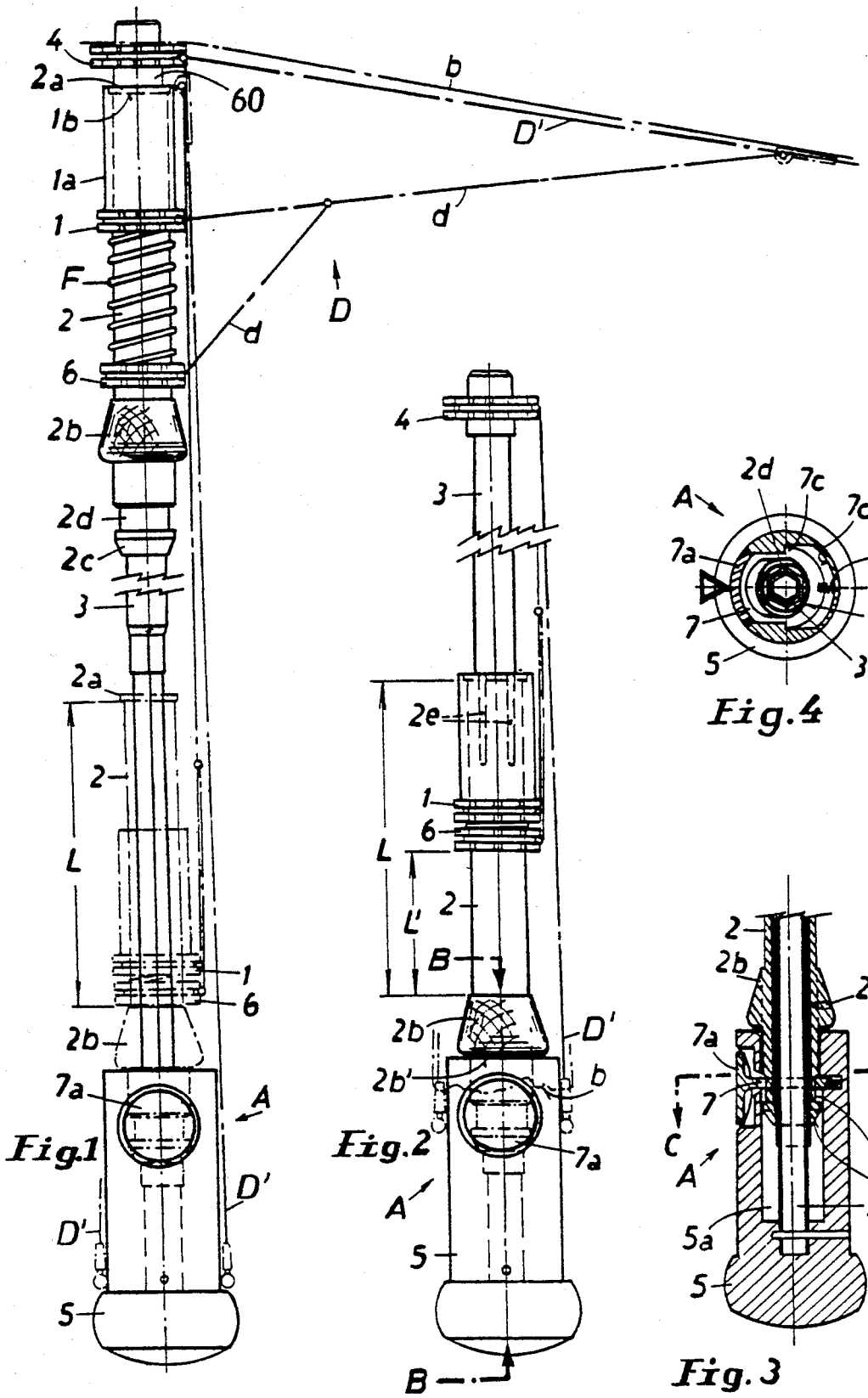
FIG. 1 shows a self-opening umbrella in which the slides and spring are in solid lines showing the frame "open" and illustrating the frame, in phantom lines in a partially "closed" condition.
FIG. 2 shows the frame in a partially "closed" state.
FIG. 3 is a partial longitudinal section on line B—B of FIG. 2.
FIG. 4 is a transverse section on line C—C of FIG. 3.

The invention can be utilized on all umbrellas of the self-opening types in which the frame or roof structure D is opened automatically by means of a compression spring F and which can be closed manually by pulling down on a grip sleeve 2 engaging an auxilary slide 1 of the frame structure. These umbrellas include those of the type which have either a rigid stick or a telescopic stick 3 and a frame structure D which can easily fold and made shorter via telescopic ribs; as seen, for example, in the patent to Zimmermann et al. 27059.

A cap 4 is mounted at the upper end of stick 3 and at the lower end of the stick is a handle 5. At the cap 4, roof ribs D'; bearing a cover b of the roof structure, are articulated (hinged) on the cap and are supported intermediately by struts d at a hinged connection, the other end of the structs d being hinged to the auxilary slide 1. Hinged intermediately of the structs d are auxilary structs d' which are hinged at their inner ends to the main slide 6. A compression spring F is fixed between these two slides 1,6 and tends to push these slides apart in the sense of the drive effect, known per se, in the umbrellas as defined in the preamble from the near handle or "closed" slide position shown on FIG. 2 into the "opened" position shown in FIG. 1 by solid lines. From this "opened position" position of FIG. 1 position, when the umbrella is not in use, the umbrella frame D is returned manually into the "closed" position according to FIG. 2 by means of the grip sleeve 2 "i.e.", by holding the grip sleeve 2 at a grip collar **2*b* and pulling it down the stick 3 to the umbrella handle 5. While, so doing, the grip sleeve 2 engages the auxiliary slide 1, at an abutement or carrier 2*a*; the closing operation can be carried out more easily that is to say with less effort since pressure is applied on top of slider 1*a***.

In order to be able to actuate the auxiliary slide 1 lying inaccessibly above the main slide 6, the grip sleeve 2, guided on the stick 3 is passed displaceably, in a manner known per se, through the main slide 6. According to the invention, however, the grip sleeve 2 is not integrally connected to the auxiliary slide 1, but is freely rotatably and displaceably passed through the latter and through the main slide 6, and is only connectable to the auxiliary slide 1 by means of a carrier or annular collar **2*a* on one directional movement towards the umbrella handle 5**.

The two slides 1 and 6 and the grip sleeve 2 are mutu ally displaceable and rotatable within a push path L which extends between the abutment or carrier **2*a* and the grip collar 2*b*. The carrier 2*a* can have the form of an annular shoulder moulded onto the upper end of the grip sleeve 2, which annular shoulder can be retractable in a recess 1*b*, conforming to it, of a housing cylinder 1*a*, accommodating the compression spring F, of the auxiliary slide 1 down to the position. In this retracted stop position on the auxiliary slide 1, the grip sleeve 2 lies in contact with the cap 4 with the opened frame or roof D, under upward spring force or in contact with a distancing ring or impact buffer 60 positioned below the cap 4**.

The grip sleeve 2 has a lower tapered end **2*c*, a stop or abutment in the form of an annular groove 2*d* is moulded or formed on, and extends around the circumference of sleeve 2 and, is effective about a full circle, and with which the grip sleeve 2 engages in a ring shaped lock 7 of an arresting catch A in the umbrella handle 5 in closed and locked state of the umbrella. The lock 7 surrounds the stick 3 and is displaceable in a guided path in the umbrella handle 5 running transversely to the stick 3 and can be disengaged from the annular groove 2*d* by means of a push button 7*a* in opposition to the effect of a spring 7*b*. The lock 7 is supported in its guide and positioning according to FIG. 4 by means of stop corners 7*c* in the umbrella handle 5 in such a way that it can exert a stroke corresponding to the trigger movement between the stop corners 7*c* and a wall 7*d* in the ring shaped grip around the stick 3 and around the annular groove 2*d*. With the aid of the cone shaped end 2*c*, the grip sleeve 2 can press the lock 7 at the rear edge 7*e* against the wall 7*d* when it is inserted into a hollow space 5*a* of the umbrella handle 5 and can snap onto lock 7 at the annular groove 2*d*. In this locking position, the grip collar 2*b* of the grip sleeve 2 can come to rest with the lower edge 2*b'* on the umbrella handle 5 and, in this manner, torms a stable entry limit of the grip sleeve 2 into the umbrella handle 5** or into the arresting catch A.

Since the grip sleeve 2 must be adapted to the maximum spread path of the compression spring F and the two slides 1 and 6, it requires a relatively long displacement path. For this reason, with a closed umbrella and a stressed, compressed compression spring F, the wide spacing of the slides 1 and 6 from the umbrella handle 5 results, as can be seen from FIG. 2, and thus also of the roof structure D and its roof ribs D' up to the end of the umbrella handle 5. Due to this distance, the distance in the length L' of FIG. 2 between the main slide 6 and the grip collar **2*b* of the grip sleeve 2 also results. Depending on the dimensioning of the length of the grip sleeve 2, this length L' or the aforementioned distance can be used for a corresponding additional shortening of the closed and locked umbrella by pushing the lower part of the umbrella with the umbrella handle 5 and the upper part of the umbrella with the roof structure D and the stick 3 against one another to such an extent that the main slide 6 and the grip collar 2*b* touch each other. The umbrella frame then takes up the position drawn in dot dashed lines in FIG. 1 corresponding to its maximum shortening with the ribs or ends of the roof rods D' pushed almost down to the end of the umbrella handle 5. The upper end of the grip sleeve 2 then projects freely with the 1 abutment or spaced above carrier 2*a* the spring housing 1*a* of the auxiliary slide 1** a distance corresponding to the additional shortened length.

For purposes of dissassembly, at its upper end bearing the carrier **2*a*, the grip sleeve 2, can be provided with longitudinal slots 2*e* cut parallel to the axis and, in this way, can very easily be passed through the two slides 1 and 6. The slotted end can thus be passed, when flexibly compressed inwardly, through the slides 1 and 6 and, after passing through the auxiliary slide 1 together with the carrier 2*a*, expands again to the necessary initial shape. However, for the purpose of this assembly, the grip sleeve 2 can also be provided with a grip collar 2*b*, which can be pushed on, and which is fixed by a transverse pin 2*e'*** or by adhesive bonding.

We claim:

1. In a self-opening umbrella having a stick and a main slide and an auxilary slide to actuate a frame structure comprising cover-supporting ribs hinged to a cap at the upper end of the stick and struts hingedly connected to each other, said struts having ends respectively hinged to said main and auxilary slides, a compression spring disposed about said stick and compressed on said stick between the slides for automatically urging said slides apart and opening the frame structure, said frame structure being closable by a grip sleeve pulling said slides together toward a lower end of said stick, a handle on the lower end of said stick, said grip sleeve and said handle including cooperating latch means for holding the umbrella frame structure in a closed condition, the improvement in which said grip sleeve comprises a tubular member freely rotatable on said stick and extending through said slides, said grip sleeve having an upper carrier abutingly engagble on the upper end of said auxilary slide, said compression spring being coiled about an intermediate portion of said tubular member between said slides, said grip sleeve having means limiting downward movement of said main slide therebelow, said auxilary and main slides having relative movement toward each other on said tubular member whereby manual closing of the frame structure is achieved by the freely rotatable grip sleeve moving on said stick through said main slide while pulling downwardly on said auxilary slide at the upper end of the grip sleeve while compressing said compression spring between said auxilary and main slides without torsional forces of said compression spring being imposed on said gripping sleeve.

2. The structure as claimed in claim 1 in which said stick comprises telescopic sections, the main slide and auxilary slide are limited in relative movement toward each other on said tubular member carrier member and an abutment define a limited path of said slide on said grip sleeve as the grip sleeve moves on the stick during opening and closing of the umbrella frame.

3. The structure as claimed in claim 1 in which said cooperating latch means comprises and annular groove portion on said grip sleeve, said umbrella handle having an open portion for receiving said annular groove portion therein, the handle including an arresting catch displacably engagable in said annular groove.

4. The structure as claimed in claim 3 in which said handle 1 includes an arresting assembly including a ring. element displacably supported on a path of movement transverse to said handle open portion and displacably engagable in said grip sleeve groove when aligned therewith, and spring means in said handle in engagement with said ring element for normally urging it toward said handle opening, and push button means in engagement with said ring element and accesibly mounted on said handle for manual operation in opposition to said spring means.

5. The structure as claimed in claim 1 in which said auxilary slide comprises a tubular member extending in circumposed relation about the grip sleeve and receiving the upper end of the compression spring therein, said tubular member of said auxilary slide having a recessed portion at its upper end into which the gripping sleeve upper carrier is received.

6. The structure as claimed in claim 1 in which said gripping sleeve has a deformable, slotted, upper end portion for facilitating disassembly and separation of said gripping sleeve from the slides.

* * * * *